US009248360B1

(12) United States Patent
Gilman

(10) Patent No.: US 9,248,360 B1
(45) **Date of Patent: *Feb. 2, 2016**

(54) TRAINER FOR DEVELOPING GRIPPING STRENGTH AND POWER

(71) Applicant: Marty Gilman, Inc., Gilman, CT (US)

(72) Inventor: Neil F. Gilman, South Glastonbury, CT (US)

(73) Assignee: MARTY GILMAN, INC., Gilman, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/693,309

(22) Filed: Apr. 22, 2015

Related U.S. Application Data

(63) Continuation of application No. 13/226,743, filed on Sep. 7, 2011, now Pat. No. 9,017,229.

(51) Int. Cl.

| | |
|---|---|
| ***A63B 21/06*** | (2006.01) |
| ***A63B 69/00*** | (2006.01) |
| ***A63B 21/00*** | (2006.01) |
| ***A63B 37/00*** | (2006.01) |
| ***A63B 43/00*** | (2006.01) |

(52) U.S. Cl.
CPC ..... *A63B 69/0071* (2013.01); *A63B 21/14* (2013.01); *A63B 37/00* (2013.01); *A63B 43/007* (2013.01)

(58) Field of Classification Search
CPC ..... A63B 21/14; A63B 37/00; A63B 43/007; A63B 43/02; A63B 69/0071; A63B 69/0079; A63B 69/0084; A63B 69/0086; A63B 69/0088; A63B 69/0091; A63B 69/20; A63B 69/201; A63B 69/203; A63B 69/205; A63B 2037/065
USPC ..... 482/44–50, 83–90, 92–99, 121, 129; 473/280, 423–425, 575, 576; 411/147, 411/157
See application file for complete search history.

(56) References Cited

U.S. PATENT DOCUMENTS

| | | | | |
|---|---|---|---|---|
| 1,326,976 | A * | 1/1920 | Schnurr | 473/147 |
| 1,399,293 | A | 12/1921 | Craig | |
| 2,184,252 | A | 12/1939 | Garrett | |
| 2,500,073 | A | 3/1950 | Hayes | |
| 2,766,799 | A | 10/1956 | Poupitch | |
| 2,941,805 | A | 1/1957 | Chupa | |
| 3,012,781 | A * | 12/1961 | Nelson | 473/430 |
| 3,717,342 | A * | 2/1973 | Haney et al. | 473/430 |

(Continued)

OTHER PUBLICATIONS

USPTO Non-Final Office Action in related U.S. Appl. No. 13/226,743, dated Dec. 5, 2013.

(Continued)

*Primary Examiner* — Oren Ginsberg
*Assistant Examiner* — Gregory Winter
(74) *Attorney, Agent, or Firm* — Day Pitney LLP

(57) ABSTRACT

A training device, including a ball and an anchored connecting structure that is anchored to the ball. A distal portion of the anchored connecting structure is a connector, extending from a distal portion of the ball, that is capable of connecting with a motion resisting device. A proximate portion of the anchored connecting structure extends into an inner volume of the ball, whereby resistance is provided to twisting and pulling motions between the anchored connecting structure and the ball, resulting from torsion and thrust loading during training.

10 Claims, 3 Drawing Sheets

(56) References Cited

U.S. PATENT DOCUMENTS

| | | | | | |
|---|---|---|---|---|---|
| 3,813,095 | A | | 5/1974 | Long | |
| 4,162,790 | A | | 7/1979 | Kelsey | |
| 4,192,044 | A | | 3/1980 | Ballerini | |
| 4,248,423 | A | | 2/1981 | Lotfy | |
| 4,257,589 | A | * | 3/1981 | Outlaw | 482/148 |
| 4,296,925 | A | * | 10/1981 | Alston | 473/430 |
| 4,616,834 | A | * | 10/1986 | Davis | 473/429 |
| 4,621,817 | A | | 11/1986 | Musacchia | |
| 5,433,438 | A | * | 7/1995 | Gilman | 482/93 |
| 5,916,046 | A | | 6/1999 | Allred et al. | |
| 6,358,163 | B1 | | 3/2002 | Tanner | |
| 6,682,445 | B1 | | 1/2004 | Tanner | |
| 7,137,914 | B1 | | 11/2006 | Boyer | |
| 7,252,607 | B2 | | 8/2007 | Gormley | |
| 7,510,511 | B2 | | 3/2009 | Von Detten | |
| 7,527,567 | B2 | | 5/2009 | Ohle | |
| 7,811,183 | B1 | * | 10/2010 | Ohle | 473/429 |
| 7,819,789 | B2 | | 10/2010 | Berman | |
| 7,985,779 | B2 | | 7/2011 | Vleghert | |
| 2005/0130814 | A1 | | 6/2005 | Nitta | |
| 2008/0090708 | A1 | * | 4/2008 | Balaker et al. | 482/138 |
| 2009/0227399 | A1 | | 9/2009 | McKay | |
| 2012/0040782 | A1 | | 2/2012 | Grabner | |
| 2012/0225740 | A1 | | 9/2012 | Gibadlo | |

OTHER PUBLICATIONS

USPTO Final Office Action in related U.S. Appl. No. 13/226,743, dated Sep. 25, 2014.

* cited by examiner

TRAINER FOR DEVELOPING GRIPPING STRENGTH AND POWER

This application is a continuation of and claims the benefit of priority to U.S. patent application Ser. No. 13/226,743, filed Sep. 7, 2011. The disclosure of the aforementioned patent application is incorporated by reference herein in its entirety.

BACKGROUND

Field of the Disclosed Embodiments

The embodiments relate to a system which provides training for gripping a basketball.

BACKGROUND OF THE DISCLOSED EMBODIMENTS

Various training systems exist for basketball athletes of all ages and skill levels. Examples include inflated basketballs of various sizes from youth to professional. Basketball training often focuses on "gripping" the ball, where feeling and squeezing the basketball is critical. Being able to catch, rebound and grip the ball with authority is a fundamental aspect of the game. Gripping is critically important in all facets of the game from ball handling, passing, rebounding and shooting.

Coaches have tried to develop drills or exercises that enhance a player's ability to "grip" the basketball. One training aid is a harness, such as multi-web strap harnesses which surround the ball in a cage. Such systems use elastic rope tails for ball handling and movement drills. Such systems, utilizing basketballs and similarly sized, non-textured medicine balls, also use non stretch leads and "D" rings attached to weight machines.

Challenges exist with harnesses, with either a basketball or a medicine ball, whether or not connected to a weight machine. There is a certain amount of gripping strength required to manipulate the ball from side to side or overhead. However, the athlete feels the web straps and does not get a feel for gripping a ball.

SUMMARY OF THE DISCLOSED EMBODIMENTS

The disclosed embodiments provide a polyurethane filled basketball with an anchored rod that is augured into the basketball. At the end of the rod is a tapped and threaded section into which an eyebolt is fastened. The eyebolt has a domed cap to seal an opening in the basketball, through which the tapped rod is inserted into the ball, and cover the rod and connected parts imbedded in the ball. With the eyebolt, the ball can be attached to the snap hook of a lateral pull-down exercise machine and does not require straps that interfere with the technique of gripping. This configuration allows a basketball player to grip a basketball and practice more realistic basketball movements against the motion resistance offered by weight machines.

BRIEF DESCRIPTION OF THE FIGURES

The provided figures, which are not limiting, illustrate the disclosed embodiments, in which.

DETAILED DESCRIPTION OF THE DISCLOSED EMBODIMENTS

Figure 3:
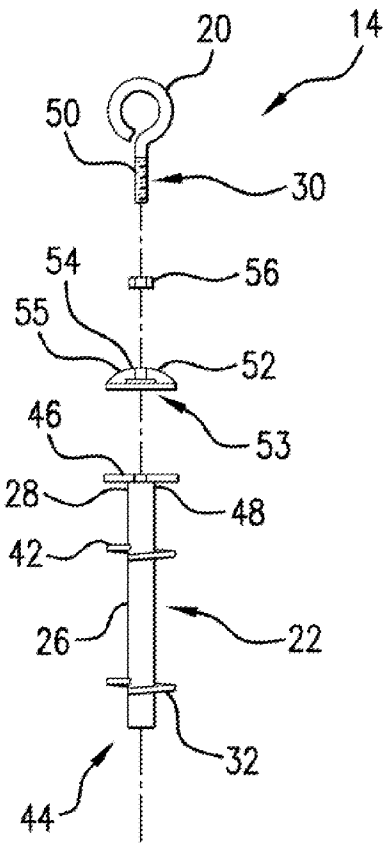
FIG. 3 illustrates an exploded view of components used in the training device.

Turning to the figures, a training device 10 is illustrated which comprises a ball 12 and a multi-component anchored connecting structure 14 that is anchored to the ball 12. A distal portion 16 of the anchored connecting structure 14 is a connector 20, extending from a distal portion 18 of the ball 12, that is capable of connecting with a motion resisting device 15. The motion resisting device 15 is only schematically illustrated, and can be, for example, a lat pull-down weight machine. Incidentally, reference has been made to the "distal" portion of the ball, and reference to the device can be further made to the "proximate" device direction, which is illustrated as a lower portion of the device 10, and where the "distal" device direction is illustrated as an upper portion of the device 10. However, other relative designations are acceptable.

Figure 1:
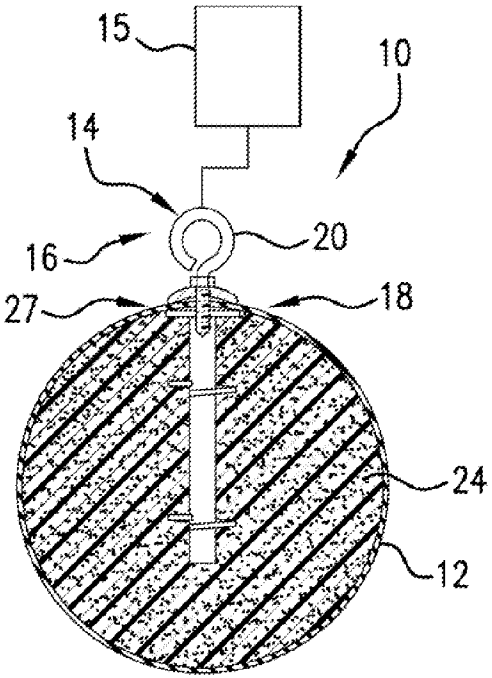
FIG. 1 illustrates a cross sectional view of the training device.

As provided in FIG. 1, a proximate portion 22 of the anchored connecting structure 14 extends into an inner volume 24 of the ball 12. From this configuration, as disclosed herein, resistance is provided to twisting and pulling motions between the anchored connecting structure 14 and the ball 12, resulting from torsion and thrust loading, during training.

While the designation of the ball 12 is generic, the ball 12 is illustrated as spherical, and more specifically, a basketball. The ball 12 can be a regulation size ball or other size ball suitable for the training requirement.

In addition, the designation of the connector 20 is also generic, and this component of the device 10 is illustrated as being a hook, and more specifically, a one inch steel eye bolt having a material thickness of five-sixteenths of an inch. The eyebolt could be a fixed type, or swivel type, which would eliminate the need for a "swivel hook" that typically attaches to a lat pull-down machine. However, it is conceivable that a climbing connector or other connector could be utilized, which is suitable for connecting with a pull-down type weight machine.

The proximate portion 22 of the anchored connecting structure 14 includes a rod 26, which is steel, having a five-eighths of an inch outer diameter and is six and a half inches long. The rod extends into a distal opening 27 in the ball 12. In addition, a distal end 28 of the rod 26 is connected to a proximate end 30 of the connector 20. As illustrated, the distal end 28 of the rod 26 is substantially planar against the distal opening 27 in the ball 12. This positions the rod 26 essentially entirely within the ball 12.

The ball 12 inner volume 24 is filled with polyurethane foam. In addition, the anchored connecting structure 14 has at least one anchoring member 32 connected to the rod 26, by, for example, welding, for securing the rod 26 to the foam. With the anchoring member 32 connected to the rod 26, the anchored connecting structure 14, and therefore, the connector 20, is secured to the ball 12.

As illustrated, the anchoring member 32 is at least one washer, which is, for example, a split or cut steel washer having an inner radius, along edge 34, of five-sixteenths of an inch so as to fit about the rod 26, an outer radius, along edge 40, of an inch and three-quarters, and a thickness of about an eighth of an inch. With the outer radius being almost double that of the inner radius, the surface area of the split washer 32 prevents axial motion of the rod 26 if the ball 12 and connector 20 are pulled away from each other from thrust loading during training.

Incidentally, reference has been made to the "radial" edge of the washer 32. The washer 32 can be further described with reference to mutually perpendicular axial, radial and circumferential directions.

As with a split washer, there is an axial flare or axial advancement of the washer 32 between opposing first and second free circumferential edges 36, 38. The result of the flare is an axial separation of opposing free circumferential edges 36, 38 of the washer 32 (FIG. 1) by a distance which is at least the thickness of the washer.

Figure 2:
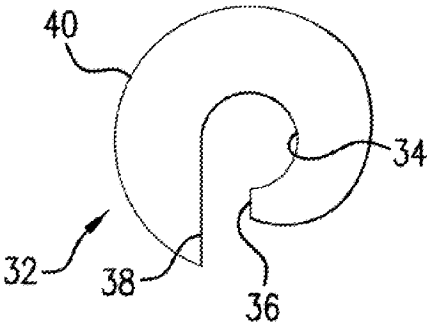
FIG. 2 illustrates a top view of a washer used in the training device.

In addition, from the flare, the opposing free circumferential edges 36, 38 of the washer 32 are, in a top view (FIG. 2), circumferentially spaced from each other. The circumferential spacing is a distance which is substantially the same as the inner radius of the washer.

Moreover, from the flare, the outer radial edge 40 at the first circumferential edge 36 is, in the top view (FIG. 2), radially set back from the outer radial edge 40 at the second circumferential edge 38. The radial setback is equivalent to a distance which is substantially the same as the inner radius of the washer 32.

As illustrated in FIGS. 1 and 3, the split washer 32 is a first split washer disposed on the rod 26, and the anchored connecting structure 14 includes a second split washer 42 which is substantially identical to the first split washer 32, and is axially spaced therefrom on the rod 26. As illustrated, the first washer 32 is offset by a first axial distance from a proximate end 44 of the rod 26, and the second washer 42 is offset by a second axial distance from the distal end 28 of the rod 26, and the second axial distance differs from the first axial distance. As illustrated, the second axial distance is greater than the first axial distance, and more specifically, is illustrated as being twice the first distance. For example, the second split washer 42 is two inches from the distal end 28 of the rod 26 while the first split washer 32 is an inch from the proximate end 44 of the rod 26.

Furthermore, the axial length of the rod 26 is approximately the same size as or greater than the radius of the ball 12. As already referenced, in the illustrated embodiment, the axial length of the rod 26 is six and a half inches, which is greater than the radius of the ball 12. Based on the axial spread between the two split washers 32, 42, both washers 32, 42 are spaced from the inner surface of the ball 12, and the washers 32, 42 are also spaced from each other. This provides resistance to both twisting and pulling motions between the anchored connecting structure 14, as a whole, and the ball 12, resulting from torsion and thrust loading, during training.

The anchored connecting structure 14 includes a third washer 46, which is a distal end washer for the rod 26. The distal end washer 46 has a same inner and outer diameters as the first washer 32. As will be discussed below, the distal end washer 46 is also a cut washer which was formed in the same manner as the first cut washer 32 and has been flattened during assembly.

The distal end washer 46 is located so that it is substantially planar and against the distal opening 27 in the ball 12. The distal end washer 46 serves as a bushing to spread bending stress at the distal end 28 of the rod 26 about the foam during use.

The distal opening 27 of the ball 12 has a diameter which is illustrated as being three-quarters of an inch, which is large enough for the rod 26 to pass axially therethrough during the manufacturing process. However, the opening 27 is not as large as the outer diameter of the washers 32, 42, 46. The flared design of the first two washers 32, 42, and the distal washer 46 when first connected to the rod 26 during assembly, enables insertion of the washers by "screwing" the rod 26 into the opening 27 in the ball 12.

The distal end 28 of the rod 26 has a radially centered female threaded portion 48, and the proximate end 30 of the connector 20 includes a male threaded stem 50. As indicated, the male threading is five-sixteenths of an inch in diameter. The female threading in the rod 26 matches the male threading in the stem 50 of the connector 20 for connecting the connector 20 to the rod 26.

The anchored connecting structure 14 includes a substantially domed or squat conical spacer 52, manufactured from aluminum, which has an outer diameter that is the same as the washers 32, 42, 46. The spacer 52 is illustrated as having an axial height of about half an inch. The spacer 52 is threaded, via a radially centered threaded through-hole 54, to the stem 50 of the connector 20, and positioned against the distal end washer 46, following the flattening of the distal end washer 46, for capping the opening 27 of the ball 12 from the outside. Here, the distal end washer 46 serves as a seat for the proximate side 53 of the spacer 52.

The anchored connecting structure 14 includes a nut 56 threaded to the stem 50 of the connector 20, so that the nut 56 is against the distal side 55 of the spacer 52. The nut 56 secures the spacer 52 from axially traveling on the stem 50 of the connector 20 after assembly.

Figure 4:
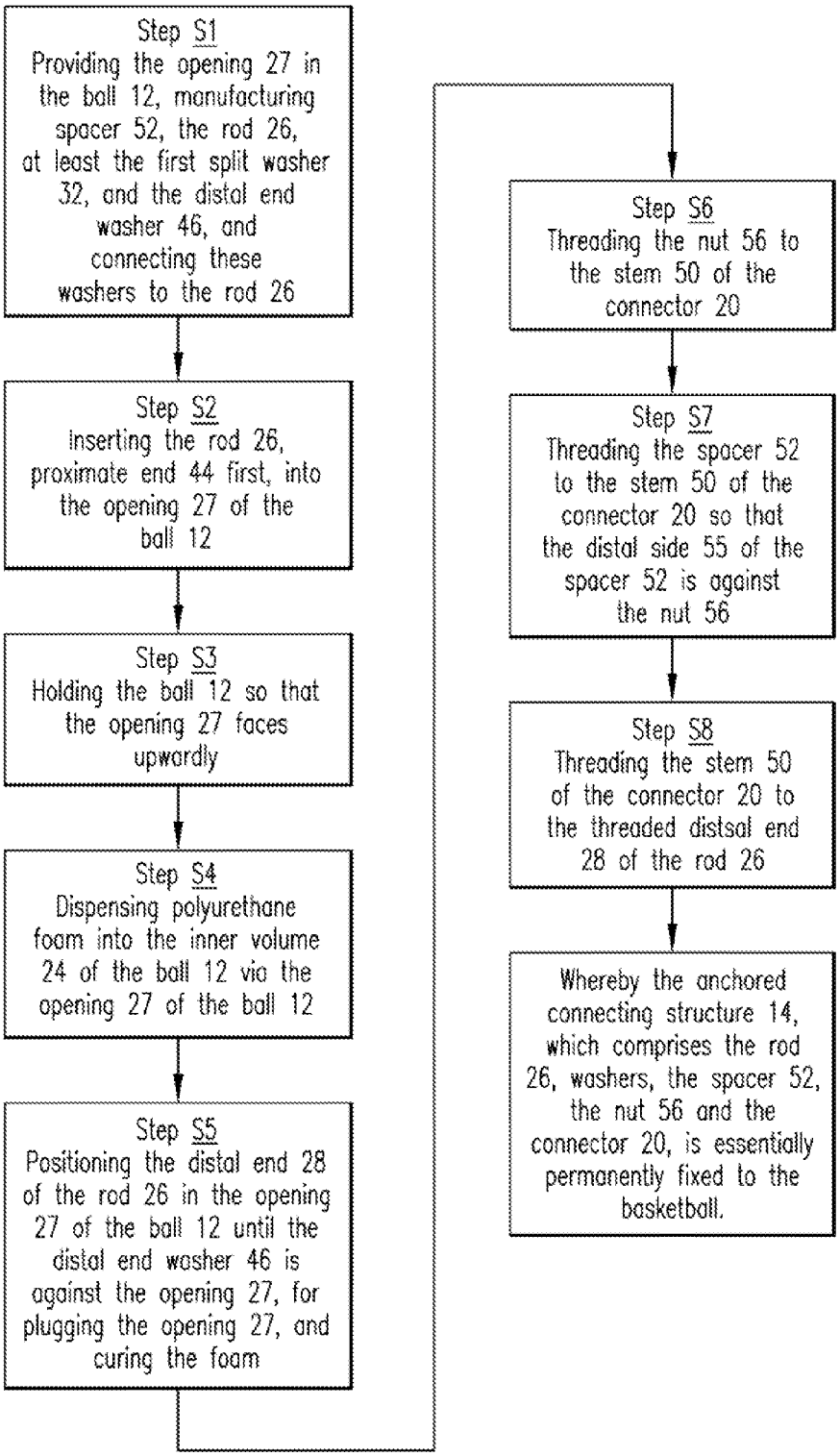
FIG. 4 illustrates a method of manufacturing the training device.

A method of manufacturing the training device will be disclosed as illustrated in FIG. 4. The method includes a first step, Step S1 of providing the opening 27 in the ball 12, manufacturing the spacer 52, the rod 26, at least the first and distal end split washers 32, 46, and connecting the at least first and distal end split washers 32, 46 to the rod 26, for example, by welding. If utilized, the second split washer 42 is manufactured and installed in this step A second step, Step S2, includes inserting the rod 26, proximate end 44 first, into the opening 27 of the ball 12. As indicated, the rod 26 is inserted into the opening 27 at the washer locations by twisting or screwing the flared washers in the manner of inserting a screw. As a result, the washers can be inserted even though the opening has a smaller diameter than the washers.

A third step, Step S3, is holding the ball 23, for example, in a jig (not illustrated). In the jig, the opening 27 in the ball 12 faces upwardly, that is, in a vertical plane.

A fourth step in the manufacturing process, Step S4, is dispensing polyurethane foam into the ball 12. The dispensing occurs via, for example, funneling, into the inner volume 24 of the ball 12 via the opening 27 of the ball 12.

A fifth step, Step S5, is positioning the distal end 28 of the rod 26 in the opening 27 of the ball 12. This configuration places the distal end washer 46 so that it is planar, that is, flush against the opening 27.

Figure 5:
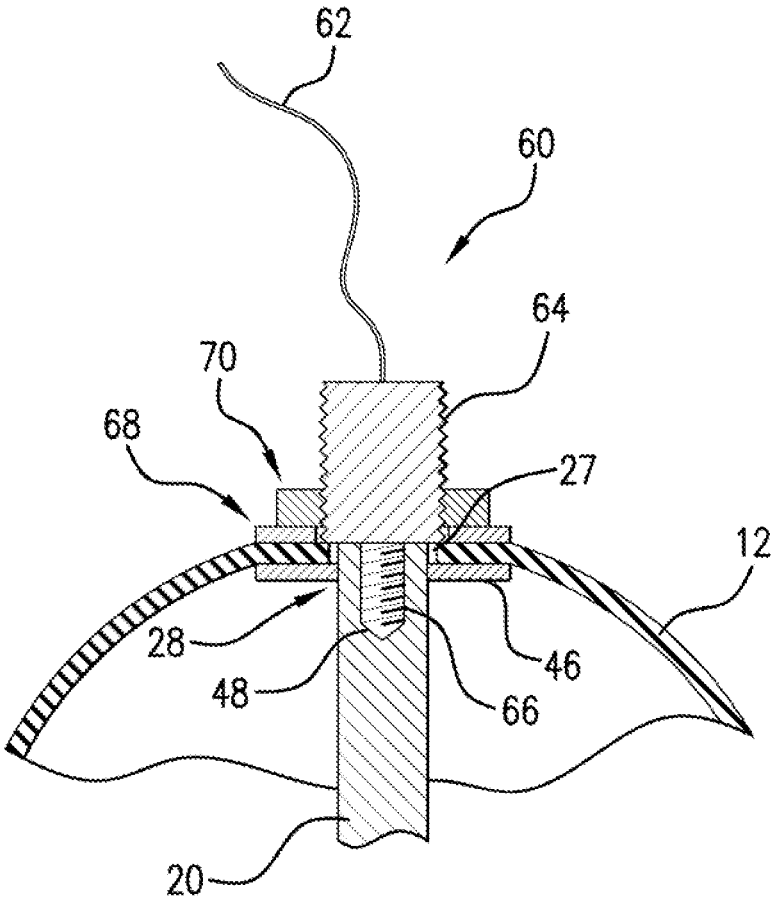
FIG. 5 illustrates a guide tool utilized in the manufacturing process.

For guiding the rod 26 in the ball 12, a guide tool 60 as illustrated in FIG. 5 can be used. The guide tool 60 includes a guide cord 62, manufactured from braided nylon cord, which is directly tethered to a three-quarters of an inch outer diameter plug 64, to which a five-sixteenths of an inch male-threaded rod 66 is threaded or otherwise fastened. The guide tool rod 66 is threaded into the female threads 48 in the distal end 28 of the rod 20.

The three-quarters of an inch guide tool plug 64 has exterior (male) threading. Once the distal end split washer 46 is aligned under the opening 27, a heavy three-quarters of an inch inner diameter washer 68 is slid over the guide tool plug 64 until it contacts the exterior surface of the ball 12. Then, a three-quarts of an inch heavy nut 70 is threaded to the guide tool plug 64 and tightened against the guide tool washer 68. This process flattens the distal end split washer 46, thereby capping the opening 27 in the ball 12 from the inside. Thereafter, the foam cures and the guide tool 60 is removed.

A sixth step, Step S6, is threading the nut 56 to the stem 50 of the connector 20. A seventh step, Step S7, is threading the spacer 52 to the stem 50 of the connector 20 so that the distal side 5 of the spacer 52 is against the nut 56. An eighth step, Step S8, is threading the stem 50 of the connector 20 to the threaded distal end 28 of the rod 26. From these steps, the anchored connecting structure 14, which comprises the rod 26, washers 32, 42, 46, the spacer 52, the nut 56 and the connector 20, is essentially permanently fixed to the ball 12.

It is within the scope of the disclosed embodiments for the training device to be supplied to a training facility coupled to a motion resisting device 15. The motion resisting device 15 would include, for example, a stationary heavy spring, that is, a spring with damping qualities, or a weight machine, such as a pull-down weight machine, which is commonly known as a cable pull-down machine, typically used for strengthening the latissimus dorsi muscle.

In sum, what is provided is a regulation size basketball that is drilled and in-filled with polyurethane foam. The machined rod, with washer clips, is effectively augured into the basketball, resulting in a ball that, under certain test conditions, has withstood up to a thousand pounds of pulling torque. The ball includes a steel eyebolt with a threaded stem and locking nut. A domed cap on the eyebolt stem seals the ball opening and conceals parts disposed within the ball. The result is a training device which does not affect the shape and feel of the ball.

The disclosed embodiments may be configured in other specific forms without departing from the spirit or essential characteristics identified herein. The embodiments are in all respects only as illustrative and not as restrictive. The scope of the embodiments is, therefore, indicated by the appended claims and their combination in whole or in part rather than by the foregoing description. All changes that come within the meaning and range of equivalency of the claims are to be embraced within their scope.

What is claimed is:

1. A training device for attachment to a resistance training machine, including:

a ball having an external layer surrounding an interior volume of injected and cured foam material, the external layer defining an opening therethrough;

an elongate shaft disposed within the ball and being surrounded by the foam, the elongate shaft being axially aligned with the opening, the elongate shaft having a first end near the opening with a threaded portion, and a second, distal end disposed within and surrounded by the injected and cured foam material;

an anchor affixed to the elongate shaft within the ball, the anchor being surrounded by the injected and cured foam material, wherein the anchor urges against the injected and cured foam material when an axial tensile force or rotational force is applied to the elongate shaft with respect to the external layer of the ball;

a coupling having a first end for attaching the training device to a cable of the resistance training machine, and a second end including a threaded portion for attaching the coupling to the threaded portion of the elongate shaft;

a first annular structural member coaxially disposed with respect to the elongate shaft and disposed against an exterior surface of the external layer of the ball, the first annular structure including a domed cap to seal the opening of the ball; and a second annular structural member disposed coaxially with respect to the elongate shaft and against an inner surface of the external layer of the ball, wherein advancement of a threaded portion of a third annular structural member urging against the domed cap disposed on the elongate shaft causes the external layer of the ball to be pinched about a periphery of the opening between the first annular structural member and second annular structural member, at least two of the second annular structural member, third annual structural member, and domed cap of the first annular structure having the same outer diameter.

2. The training device of claim 1, wherein the ball is spherical.

3. The training device of claim 2, wherein the ball is a basketball.

4. The training device of claim 1, wherein the coupling is a hook.

5. The training device of claim 4, wherein the coupling includes an eyebolt.

6. The training device of claim 5, wherein the hook is a swivel eye bolt.

7. The training device of claim 1, wherein the first end of the elongate shaft is substantially co-planar with an outer surface of the ball.

8. The training device of claim 1, wherein the injected and cured foam material includes polyurethane foam.

9. The training device of claim 1, wherein the axial length of the elongate shaft is the same size as or greater than a radius of the ball.

10. A resistance training system including the training device of claim 1 coupled to a mechanical resistance including a weight machine.

* * * * *